United States Patent [19]

Satow et al.

[11] Patent Number: 4,886,434

[45] Date of Patent: Dec. 12, 1989

[54] SCROLL COMPRESSOR HAVING DISCHARGE PART COMMUNICATING WITH TWO COMPRESSION SPACES SIMULTANEOUSLY

[75] Inventors: Aritomo Satow, Fukaya; Shinichi Masuda, Isesaki; Kazuyoshi Sugimoto; Yuji Muta, both of Oizumi, all of Japan

[73] Assignee: Sanyo Electric Co., Ltd., Osaka, Japan

[21] Appl. No.: 155,531

[22] Filed: Feb. 12, 1988

[30] Foreign Application Priority Data

| | | | |
|---|---|---|---|
| Feb. 20, 1987 | [JP] | Japan | 62-38259 |
| Mar. 2, 1987 | [JP] | Japan | 62-47377 |
| Mar. 2, 1987 | [JP] | Japan | 62-47378 |
| Apr. 10, 1987 | [JP] | Japan | 62-89033 |

[51] Int. Cl.[4] ..... F04C 18/04

[52] U.S. Cl. ..... 418/55 D

[58] Field of Search ..... 418/55, 59

[56] References Cited

U.S. PATENT DOCUMENTS 4,464,100 8/1984 Machida et al. ..... 418/55 R

FOREIGN PATENT DOCUMENTS

| | | | |
|---|---|---|---|
| 3521253 | 12/1986 | Fed. Rep. of Germany | 418/55 |
| 58-135393 | 8/1983 | Japan | 418/55 |
| 58-170884 | 10/1983 | Japan | 418/55 |
| 60-169687 | 9/1985 | Japan | 418/55 |
| 60-230585 | 11/1985 | Japan | 418/55 |
| 61-175293 | 8/1986 | Japan . | |
| 61-226590 | 10/1986 | Japan | 418/55 |

*Primary Examiner*—John J. Vrablik

*Attorney, Agent, or Firm*—Wenderoth, Lind & Ponack

[57] ABSTRACT

There is provided a scroll compressor in which a plurality of compression spaces are formed by fixed and orbiting scroll members, each pair of which compression spaces are formed symmetrically with respect to the center thereof. A discharge port from which a fluid refrigerant compressed in the paired compression spaces is discharged is provided in the central portion of the end plate of the fixed scroll so that the center of the discharge port is communicated to the two compression spaces simultaneously.

2 Claims, 5 Drawing Sheets

SCROLL COMPRESSOR HAVING DISCHARGE PART COMMUNICATING WITH TWO COMPRESSION SPACES SIMULTANEOUSLY

BACKGROUND OF THE INVENTION

The present invention relates to an improvement in a scroll compressor adapted to discharge fluid, such as a fluid refrigerant compressed in a pair of compression spaces, from a discharge port at the same time.

A conventional scroll compressor is constructed as shown in, for example, Japanese Patent Appln. Laid-open No. 175293/1986. A conventional example of a scroll compressor will now be described with reference to this publication. Referring to FIGS. 9 and 10, reference numeral 50 denotes a sealed container, in which a scroll compressor unit 51 and an electric motor unit 52 are housed. The scroll compressor unit 51 consists mainly of a fixed scroll member 53, an orbiting scroll member 54, an Oldham's ring 55, a driving shaft 56, a frame 57 and a metal bearing 58.

The fixed scroll member 53 is provided with a spiral wrap 60 extending from the lower surface of an end plate 59 at right angles thereto, which wrap 60 is formed so as to extend along an involute curve or a curve similar thereto and to have a constant thickness along substantially all its length. This scroll member 53 is further provided at its outer circumferential portion with a suction port 61 for a gas to be compressed, and a discharge port 62 at the central portion of the end plate 59. The fixed scroll member 53 is secured to the frame 57. The orbiting scroll member 54 is provided with an end plate 63, and a spiral wrap 64 extending from the upper surface of the end plate 63 at right angles thereto. The wraps 60, 64 of the fixed and orbiting scroll members 53, 54 are shaped in a mutually end-face symmetric relation and staggered from each other at 180°. The fixed and orbiting scroll members 53, 54 are engaged with each other with the centers of the wraps thereof staggered by a distance equal to the radius of an orbiting movement of the orbiting scroll member 54. Accordingly, these two wraps 60, 64 contact each other at a plurality of points to form a plurality of compression spaces 65. The orbiting scroll member 54 is provided on its lower surface with a boss 66 into which the driving shaft 56 is inserted. The driving shaft 56 is supported on the frame 57 by the metal bearing 58. A rotor 67 in the electric motor unit 52 is mounted on one end portion of the rotary shaft 56, and the other end portion thereof is inserted into the boss 66 of the orbiting scroll member 54.

The winding starting angle of the wrap 60 of the fixed scroll member 53 is made to be larger than that of the wrap 64 of the orbiting scroll member 54. Namely, the length of the starting end portion of the wrap of the fixed scroll member 53 is made smaller than that of the corresponding portion of the orbiting scroll member 54.

In the scroll compressor of this construction, the length of the winding starting portion of the wrap 60 of the fixed scroll member 53 is set smaller, and a compression space 65A formed between the outer surface of the wrap of the fixed scroll member 53 and the inner surface of the wrap of the orbiting scroll member 54 and a compression space 65B formed between the inner surface of the wrap of the fixed scroll member 53 and the outer surface of the wrap of the orbiting scroll member 54 are made so as to be not communicated with a discharge port 62 simultaneously via a flow passage of a large cross-sectional area, whereby the occurrence of overcompression in one compression space 65A can be prevented.

Since the length of the winding starting portion of the wrap 60 of the fixed scroll member 53 is set smaller by increasing the winding starting angle of the same portion, the winding starting portion of the wrap 60 of the fixed scroll member 53 is separated from the wrap 64 of the orbiting scroll member 64 before the winding starting portion of the wrap 64 of the orbiting scroll member 54 has been separated from the wrap 60 of the fixed scroll member 53, so that the compression space 65A is communicated with the discharge port 62 before the compression space 65B. Consequently, a difference occurs between the pressure in the compression space 65A and that in the compression space 65B. Due to such a pressure imbalance in the compression spaces 65A, 65B, abnormal vibrations and abnormal sounds occur in the scroll compressor.

SUMMARY OF THE INVENTION

An object of the present invention is to provide a scroll compressor of the type described hereinbefore, but which permits a pair of compression spaces to be communicated with the discharge port simultaneously.

Another object of the present invention is to provide a scroll compressor which can prevent generation of a pressure imbalance in the two compression spaces.

A further object of the present invention is to provide an improved scroll compressor in which the center of a discharge port provided in the end plate of the fixed scroll member is deflected or away from the center of a basic circle of the wrap of this fixed scroll member toward the winding starting end of the wrap of the fixed scroll member.

To these ends, the present invention provides a scroll compressor which a plurality of compression spaces are formed by fixed and orbiting scroll members, between each pair of in which compression spaces are formed symmetrically with respect to the center thereof. A discharge port from which a fluid refrigerant compressed in the paired compression spaces is discharged is provided in the central portion of the end plate of the fixed scroll member so that the center of the discharge port is communicated to the two compression spaces simultaneously.

In a preferred embodiment of the invention, the center of the discharge port provided in the end plate of the fixed scroll member is offset or, in other words, spaced from the center of a basic circle of the wrap of the fixed scroll member toward the winding starting end of the wrap of the fixed scroll member. In this structure, a pair of compression spaces are communicated simultaneously with the discharge port to enable the fluid refrigerant compressed in these compression spaces to be discharged equally from the discharge port. Consequently, the pressures in the two compression spaces become substantially equal, so that no pressure imbalance occurs in the scroll compressor. In another embodiment of the invention, the discharge port is formed so that it has an elongated or oblong cross-sectional shape having a longitudinal side thereof inclined in the same direction as the direction of the winding starting end of the wrap of the orbiting scroll member. The discharge port of the elongated cross-sectional shape permits a simultaneous communication between the discharge port and the two compression spaces so that a generation of the pressure difference between the compression spaces can be prevented.

In a further embodiment of the invention, the discharge port is formed with the combination of a small hole and a large hole so that the two holes are connected to each other in a partly overlapped relation and each of the small and large holes is simultaneously communicated to the paired compressed spaces. This structure permits the reduction of a flowing resistance of a fluid refrigerant discharged out of the two compressed spaces, without a communication between the discharge port and the two spaces during the compression.

In a further modification of the invention, the end plate of the fixed scroll member is provided with a passage so that it is initially communicated to one of the compression spaces, with the result that the discharge port is simultaneously communicated to both the paired compression spaces.

BRIEF DESCRIPTION OF THE DRAWINGS

FIGS. 4 and 5 show a second embodiment of the invention, wherein:

FIG. 4 is a sectional view of the fixed and orbiting scroll members showing a positional relation of the two scroll members and the discharge port immediately before a discharge stage; and FIG. 5 is similar to FIG. 4 but shows a positional relation of the two scroll members and the discharge port in the initial discharging stage, FIGS. 6, 7 and 8 show a third embodiment of the invention wherein:

FIG. 6 is a sectional view of the fixed and orbiting scroll members showing a positional relation of the scroll members and the discharge port immediately before the discharging step;

FIG. 7 is similar to FIG. 6 but shows a positional relation of the scroll members and the discharge port in the initial discharging stage;

FIG. 8 is a sectional view of a part of the fixed scroll member,

FIGS. 9 and 10 show a conventional example of the scroll compressor, wherein:

FIG. 9 is a sectional elevation of the conventional scroll compressor; and

FIG. 10 is a sectional view of a principal portion of the scroll compressor of FIG. 9, showing the condition of engagement of the fixed and orbiting scroll members.

PREFERRED EMBODIMENTS OF THE INVENTION

Figure 1:
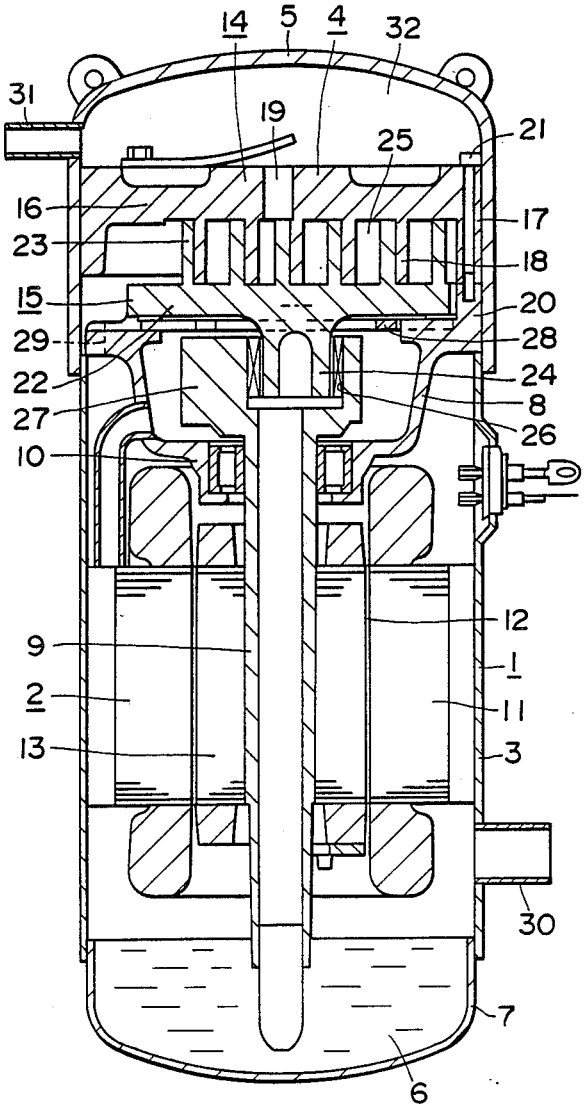
FIG. 1 is a sectional elevation of the scroll compressor according to the present invention.
Figure 2:
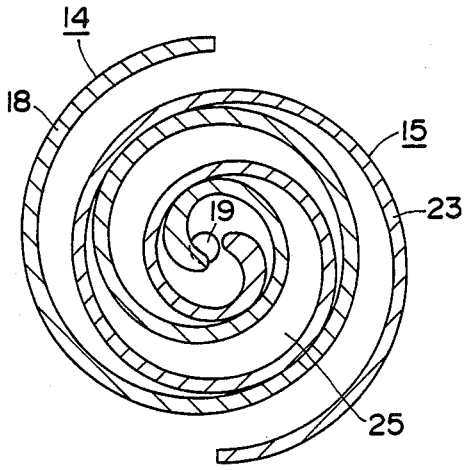
FIG. 2 is a schematic diagram of the fixed and orbiting scroll members of the scroll compressor shown in FIG. 1.
Figure 3:
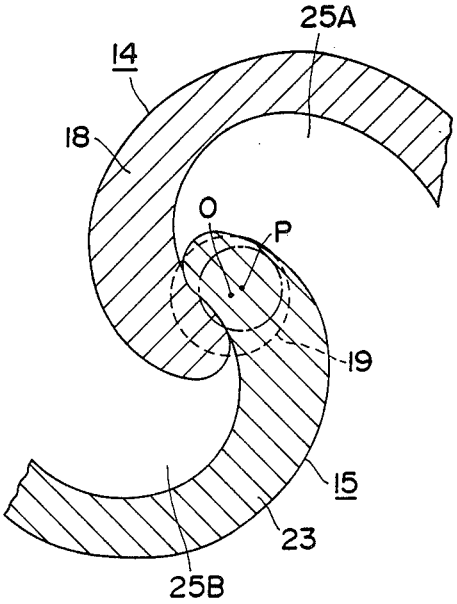
FIG. 3 is an enlarged sectional view of a part of the fixed and orbiting scroll members shown in FIG. 2, showing the relation between the wraps and the discharge port.

Preferred embodiments of the present invention will now be described with reference to the accompanying drawings. With reference first to FIGS. 1–3, a sealed container 1 has a cylindrical case 3 to which an electric motor unit 2 is fixed, an upper cover 5 to which a scroll compressor unit 4 is fixed, and a lower cover 7 having an oil reservoir 6 in which an oil is stored. A frame 8 fixed to the scroll compressor unit 4 is placed on the upper end surface of the cylindrical case 3. The frame 8 is provided at the central portion thereof with a bearing portion 10 formed integrally therewith and supporting a driving shaft 9. The electric motor unit 2 has a stator 11 fixed to the inner surface of the cylindrical case 3, and a rotor 13 mounted on the portion of the driving shaft 9 with an air gap 12 between the inner surface of the stator 11 and the rotor 13. The scroll compressor unit 4 has a fixed scroll member 14 and an orbiting scroll member 15.

The fixed scroll member 14 has a disc type end plate 16 by which the interior of the sealed container 1 is divided into upper and lower inner spaces, an annular wall 17 projecting from the circumferential portion of one surface of the end plate 16, and a spiral wrap 18 surrounded by this annular wall 17 and extending vertically from the end plate 16 so as to have an involute or nearly involute cross-sectional shape and a constant thickness. The end plate 16 of the fixed scroll member 14 is provided with a discharge port 19 in the central portion thereof. The annular wall 17 and wrap 18 of the fixed scroll member 14 project downward, and the annular wall 17 is fixed on a mounting projection 20 of the frame 8 by bolts 21.

The orbiting scroll member 15 has an end plate 22, a spiral wrap 23 extending vertically from one surface of the end plate 22 so as to have an involute or nearly involute cross-sectional shape, and a pin portion 24 formed on the central portion of the other surface of the end plate 22. The wrap 23 of the orbiting scroll member 15 extends upward so as to engage the wrap 18 of the fixed scroll member 14 in an opposed relation and form a plurality of compression spaces 25 on the inner side of the wraps 23, 18. A boss bore 26 is provided at the upper end portion of the driving shaft 9 so that the pin portion 24 of the orbiting scroll member 15 can be inserted therein, the center of the boss bore 26 being laterally offset from the axis of the driving shaft 9. A balance weight 27 is formed integrally with an upper portion of the driving shaft 9 which is around the boss bore 26. An Oldham ring 28 is adapted to be turned along a circular orbit in such a manner that the orbiting scroll member 15 does not apparently revolve around its own axis with respect to the fixed scroll member 14 but turns along the circular orbit. A suction passage 29 for introducing a fluid refrigerant into the scroll compressor unit 4 is formed at the outer circumferential portion of the frame 8.

In FIG. 3, a center O of the discharge port 19 is spaced from the center P of a basic circle of the wrap 18 of the fixed scroll member 14 toward the winding starting end of the same wrap 18.

In FIG. 1, a suction pipe 30 is opened in the portion of the interior of the sealed container 1 which is below the electric motor unit 2, and a discharge pipe 31 is joined to the upper cover 5 and opened in an upper space 32 defined by the upper cover 5 and the end plate 16 of the fixed scroll member 14.

When the electric motor unit 2 in the scroll compressor thus constructed is driven, the rotational force thereof is transmitted to the orbiting scroll member 15 via the driving shaft 9. The orbiting scroll member 15 is driven by the pin portion 24 inserted into the boss bore 26 in the driving shaft 9 eccentrically with respect to the axis of the same shaft 9, and it is thereby turned along a circular orbit so that the apparent revolution of the orbiting scroll member 15 around its own axis with respect to the fixed scroll member 14 can be prevented by the Oldham ring 28. During this time, the volume of the compression spaces 25 formed by the fixed and orbiting scroll members 14, 15, respectively, is reduced gradually from the other side to the inner side of the compression space 25 to compress the fluid refrigerant which flows from the suction pipe 30 into the interior of the sealed container 1 and runs through the suction passage 29 at the outer circumferential portion of the frame 8 via the air gap 12 in the electric motor unit 2. The compressed refrigerant is discharged from the discharge port 19 in the end plate 16 of the fixed scroll member 14 into the upper space 32 and sent out from the discharge pipe 31 to the outside of the sealed container 1.

Since the center O of the discharge port 19 is offset from the center P of a basic circle of the wrap of the fixed scroll member 14 in a direction toward the winding starting end of the wrap 18 of the fixed scroll member, the communication of the compression space 25A, which is one of the compression spaces 25 formed symmetrically with respect to the center thereof, and which is defined by the inner surface of the wrap 18 of the fixed scroll member 14 and the outer surface of the wrap 23 of the orbiting scroll member 15, with the discharge port 19 is delayed, as compared with when the centers coincide, and the communication of the compression space 25B, which is defined by the outer surface of the wrap 18 of the fixed scroll member 14 and the inner surface of the wrap 23 of the orbiting scroll member 15, with the discharge port 19 is sped up, as compared with when the centers coincide, when the winding starting end of the wrap 23 of the orbiting scroll 15 passes the discharge port 19, to enable these two compression spaces 25A, 25B to be communicated with the discharge port 19 at substantially the same time, and the fluid refrigerant compressed in the compression spaces 25A, 25B to be discharged equally. Since the fluid refrigerant compressed in the compression spaces 25A, 25B is discharged simultaneously from the discharge port 19, the occurrence of a difference in the discharge port-communicating condition of the compression spaces 25A, 25B which causes a difference in the pressures therein, can be prevented.

According to the above-described embodiment of the present invention, the center O of the discharge port 19 is spaced from the center P of a basic circle of the fixed scroll member 14 toward the winding starting end of the wrap 18 of the same scroll member 14 so as to enable the compression spaces 25A, 25B to start to open so that the starting end portions of the these compression spaces 25A, 25B form a circular portion the diameter of which is substantially equal to that of the discharge port 19, and the flow rates and condition of the refrigerant flowing from these compression spaces 25A, 25B into the discharge port 19 are equalized, whereby the occurrence of a difference between the pressure in the compression spaces 25A, 25B can be prevented.

In the scroll compressor according to the present invention, a plurality of compression spaces are formed by the fixed and orbiting scroll members, each pair of which compression spaces are formed symmetrically with respect to the center thereof, and the discharge port from which a refrigerant compressed in these two compression spaces is discharged is provided in the central portion of the end plate of the fixed scroll member so that the center of the discharge port is spaced from the center of a basic circle of the wrap of the fixed scroll member toward the winding starting end thereof. Therefore, the cross-sectional areas of openings which are formed by the starting end portions of a pair of compression spaces when these compression spaces start to open and communicated with the discharge port can be made to be substantially equal. This enables the condition of the refrigerant discharged from these compression spaces into the discharge port to be equalized, and the occurrence of a difference in the pressure in the compression spaces to be prevented. Accordingly, the occurrence of abnormal vibrations of the scroll compressor and abnormal sounds therein can be prevented.

Figure 4:
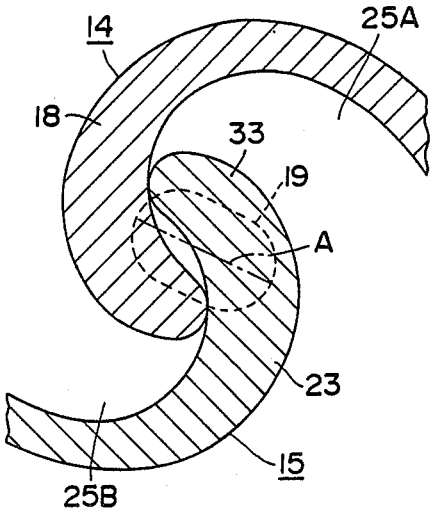
Figure 5:
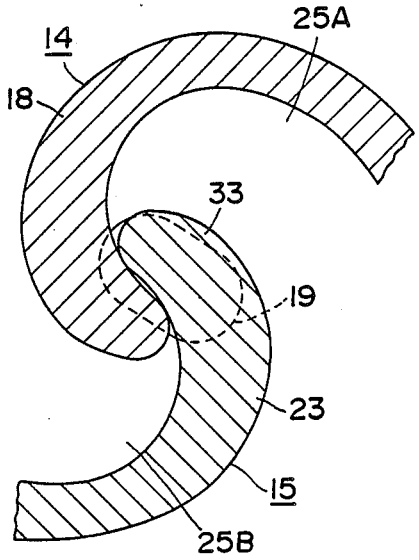

FIGS. 4 and 5 show another embodiment of the invention, in which a discharge port has an elongated cross sectional shape with a longitudinal direction thereof being inclined in the same direction as the direction of the winding starting end of the wrap of the orbiting scroll member. The discharge port with the elongated cross sectional shape permits a simultaneous communication between the discharge port and a pair of the compression spaces, thereby preventing generation of a pressure difference between the compression spaces.

Referring to FIGS. 4 and 5, the discharge port 19 is formed such that it has an oblong cross-sectional shape such that its oblong or elongated side, which is referred to as a chain-line A in FIG. 4, is inclined in a direction substantially the same as the direction of the winding starting end of the wrap 23 of the orbiting scroll member 15. In the illustrated embodiment, after the winding end 33 of the orbiting scroll member 15 runs across, and closes, the discharge port 19, the discharge port is communicated to each of the two compression spaces 25A, 25B simultaneously when the discharge port 19 is again opened so that no pressure difference is generated in the compression spaces 25A and 25B due to any delay of timing of opening and closing of the discharge port 19, thereby preventing generation of abnormal vibration and/or sound due to unnecessary pressure on the orbiting scroll member 15 by the pressure difference as described above. Further, the oblong shaped cross-section of the discharge port 19 permits the resistance of a passing fluid refrigerant discharged from the two compression spaces 25A and 25B to become decreased without providing a communication between the discharge port 19 and the compression spaces 25A, 25B in which fluid is being compressed. In this embodiment, the cross-sectional area of the discharge port 19 can be made larger to decrease the flow resistance.

Figure 6:
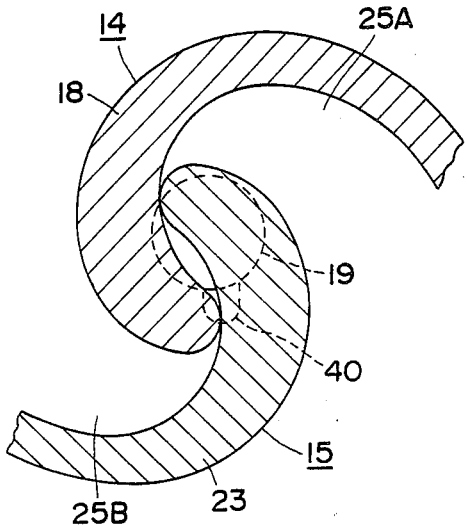
Figure 7:
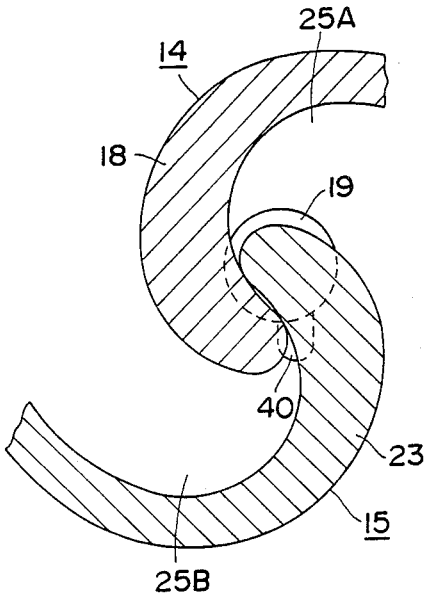
Figure 8:
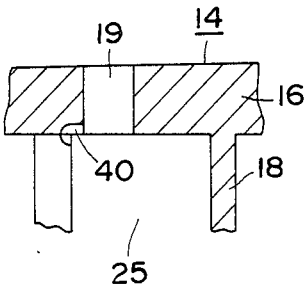

FIGS. 6, 7 and 8 show a further embodiment in which a passage is provided in the end plate of the fixed scroll member in such a manner that the passage is communicated to the discharge port and that the passage is initially opened to one of the compression spaces.

Figure 9:
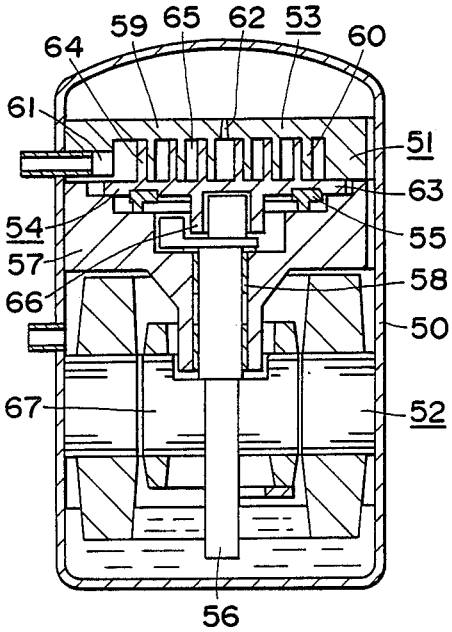
FIG. 9 (PRIOR ART)
Figure 10:
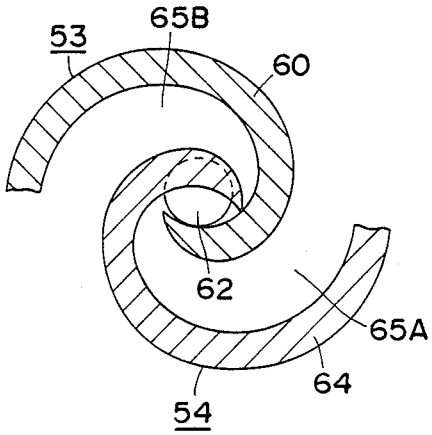
FIG. 10 (PRIOR ART)

In FIGS. 7, 8 and 9, the end plate 16 of the fixed scroll member 14 is provided with a passage 40 which is opened to one of the compression spaces, that is the space 25B, in the initial stage of the compression so that the passage 40 is communicated to the discharge port 19. On the other hand, the discharge port 19 is initially opened to the other compression space 25A.

By the structure in the embodiment of FIGS. 6, 7 and 8, the two compression spaces 25A and 25B are simultaneously connected to the discharge port 19 and, accordingly, no pressure difference is produced between the compression spaces 25A and 25B due to the delay of timing of opening and closing operations. In this embodiment, it is not necessary that the discharge port 19 be opened at the same time to both of the compressed spaces. Thus, no special working or finishing treatment is necessary to the shape of the discharge port 19 and therefore it permits an easy forming of the discharge port 19.

While the invention has been described in the specification and illustrated in the drawings with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention will not be limited to the particular embodiment illustrated by the drawings and described in the specification as the best mode presently contemplated for carrying out this invention, but that the invention will include any embodiments falling within the scope of the appended claims.

What is claimed is:

1. A scroll compressor comprising:

a sealed container, a compressor unit disposed in an upper portion of said sealed container, and an electric motor unit disposed in a lower portion of said sealed container, wherein said compressor unit comprises:

a fixed scroll member having an end plate and a wrap attached to one surface of said end plate and having the shape of an involute curve, and an orbiting scroll member have an end plate and an orbiting scroll wrap attached to one surface of said end plate of the orbiting scroll member in a juxtaposed relation with said fixed scroll member so that the wraps of the two scroll members are fitted closely together to form a plurality of compression spaces, said orbiting scroll wrap having a constant thickness along substantially all its length, said compression spaces being defined gradually from an outer side of said scroll members toward an inner side thereof and formed symmetrically with respect to a center of said fixed scroll member, said end plate of the fixed scroll member having a circular discharge port for discharging therethrough a refrigerant compressed in said compression spaces, the center of said discharge port of said fixed scroll member being offset from the center of a basic circle of the wrap of said fixed scroll member toward the winding starting end of the wrap of said fixed scroll member and having a size for causing said compression spaces to be connected to said discharge port simultaneously so that the fluid in said compression spaces is discharged simultaneously from said discharge port to prevent pressure difference between said compression spaces.

2. A scroll compressor comprising:

a sealed container, a compressor unit disposed in an upper portion of said sealed container, and an electric motor unit disposed in a lower portion of said sealed container, wherein said compressor unit comprises:

a fixed scroll member having an end plate and a wrap attached to one surface of said plate and having the shape of an involute curve, and an orbiting scroll member having an end plate and an orbiting scroll wrap attached to one surface of said end plate of the orbiting scroll member in juxtaposed relation with said fixed scroll member so that the wraps of the two scroll members are fitted closely together to form a plurality of compression spaces, said orbiting scroll wrap having a constant thickness substantially all its length, said compression spaces being defined gradually from an outer side of said scroll members toward an inner side thereof and formed symmetrically with respect to a center of said fixed scroll member, said end plate of the fixed scroll member having a discharge port for discharging therethrough a refrigerant compressed in said compression spaces, said discharge port having an oblong cross-sectional shape having opposite longitudinal sides inclined in the same direction as the direction of the winding starting end of the wrap of the orbiting scroll member and having a size for causing said compression spaces to be connected to said discharge port simultaneously to prevent pressure difference between said compression spaces.

* * * * *